US006908371B2

(12) United States Patent
Janzen

(10) Patent No.: US 6,908,371 B2
(45) Date of Patent: Jun. 21, 2005

(54) ULTRASONIC CONDITIONING DEVICE CLEANER FOR CHEMICAL MECHANICAL POLISHING SYSTEMS

(75) Inventor: John W. Janzen, Andover, MN (US)

(73) Assignee: Honeywell International, Inc., Morristown, NJ (US)

( * ) Notice: Subject to any disclaimer, the term of this patent is extended or adjusted under 35 U.S.C. 154(b) by 210 days.

(21) Appl. No.: 10/303,458

(22) Filed: Nov. 25, 2002

(65) Prior Publication Data

US 2003/0073391 A1 Apr. 17, 2003

Related U.S. Application Data

(62) Division of application No. 09/911,531, filed on Jul. 24, 2001, now abandoned.

(51) Int. Cl.[7] ..... B24B 1/00

(52) U.S. Cl. ..... 451/72; 451/56; 451/285; 451/444

(58) Field of Search ..... 451/72, 56, 443, 451/444, 228, 134, 41, 28, 256

(56) References Cited

U.S. PATENT DOCUMENTS 5,683,289 A 11/1997 Hempel, Jr.
5,823,854 A 10/1998 Chen
5,868,608 A 2/1999 Allman et al.
5,876,508 A 3/1999 Wu et al.
5,906,754 A 5/1999 Appel et al.
5,985,093 A 11/1999 Chen
6,095,908 A * 8/2000 Torii ..... 451/285
6,126,531 A * 10/2000 Iida et al. ..... 451/447
6,162,728 A 12/2000 Tsao et al.
6,168,502 B1 1/2001 Allman et al.
6,261,162 B1 * 7/2001 Hirokawa et al. ..... 451/285
2002/0072312 A1 * 6/2002 Park et al. ..... 451/56
2002/0106971 A1 * 8/2002 Rodriquez et al. ..... 451/5

* cited by examiner

*Primary Examiner*—Lee D. Wilson
(74) *Attorney, Agent, or Firm*—Schiff Hardin LLP

(57) ABSTRACT

A method and system for cleaning conditioning devices used in chemical mechanical polishing (CMP) systems is disclosed. The system includes a robotic arm for holding and transporting the conditioning device between the polish pad area of the machine and the conditioning device cleaning area. The cleaning area consists of an ultrasonic tank containing a liquid for the purpose of removing particles, residues and contaminants from the conditioning device and its mounting hardware. Removal of contaminants from the conditioning device leads to reduced defect levels in the CMP process.

14 Claims, 1 Drawing Sheet

ULTRASONIC CONDITIONING DEVICE CLEANER FOR CHEMICAL MECHANICAL POLISHING SYSTEMS

CROSS-REFERENCE TO RELATED APPLICATION

This Application is a divisional of parent application Ser. No. 09/911,531, filed Jul. 24, 2001 now abandoned.

BACKGROUND

1. Technical Field

The present invention relates generally to methods and apparatuses for polishing semiconductor devices and, more specifically, methods and apparatuses used in the chemical mechanical polishing of semiconductor and related devices. Still more specifically, the present invention relates to methods and apparatuses for cleaning a conditioning device used for the conditioning of polish pads used in a chemical mechanical polishing system.

2. Description of the Related Art.

As the size of electronic devices and circuit dimensions become smaller, it becomes increasingly desirable to planarize and smooth wafer surfaces. Specifically, with smaller circuit dimensions, the value of each unit area of a semiconductor wafer becomes higher because an increasing percentage of the wafer surface is used for surface components. In order to reliably form an integrated circuit with advanced circuit designs that use higher percentages of the wafer surface area for these smaller surface components, it is desirable that the wafer surface area be relatively defect free or that the defects be reduced below levels which were previously acceptable.

Currently, to meet the demand for semiconductor wafers with a highly planarized and smooth surface, manufacturers rely upon chemical mechanical polishing (CMP) processes. CMP can be used for planarizing bare silicon wafers, interlevel dielectrics, metals, and other materials. CMP involves the use of a polish pad in combination with a chemical mixture known as a slurry. The slurry may or may not contain an abrasive component. CMP has proven useful for fabrication of integrated circuits, miniature optical and mechanical devices, disk drives, magnetic heads, and may other devices.

Typically in a CMP process, the wafer being processed is held on a carrier which may be rotated while the face of the wafer is pressed against a resilient polishing pad that is attached to a rotating platen or a traveling belt arrangement. A slurry is applied to the pad to lubricate the interface between the wafer and the polishing pad. The slurry also serves the function of mildly abrading or affecting the surface of the wafer due to its abrasive and/or other components. Chemicals may be added to the slurry that catalyze reactions which break chemical bonds within the polished material to help increase the polishing rate. An abrasive component may or may not need to be present.

Polishing pads are typically formed from a polymer with a cellular microstructure with numerous voids between individual cells that serve as pockets that hold slurry. As the pad contacts the wafers, the cellular microstructure tends to abrade or wear, which changes its ability to trap slurry. The result is changes in the polishing processes such as polish rate change, uniformity change etc. In order to combat these effects, a pad conditioning system can be employed.

A pad conditioning system typically presses an abrasive conditioning disk or ring onto the pad surface and has the ability to move the conditioning disk to various locations or tracks on the pad surface. These conditioning systems are only partially effective because as they condition the pad, they cause the pad to wear out faster thus, decreasing the usable life of the pad. Conditioning systems also tend to elevate defect levels because they shed particles themselves and tend to break particles free from the pad surface. Conditioning disks and rings also tend to become covered with polishing slurry which if not carefully cleaned away, can agglomerate as time goes by and shed particles onto the polish pad, thereby causing defects on the wafers being polished.

Recently, systems have been developed which employ ultrasonic energy in combination with pad conditioning during the conditioning process in an attempt to remove particles from the polish pad and to effect the pad conditioning process itself. Examples of this technique are found in related U.S. Pat. Nos. 5,868,608 and 6,168,502 as well as U.S. Pat. No. 5,906,754. These patents address the issue of applying ultrasonic energy for polish pad conditioning but do not address the issue of cleaning the conditioning device itself, outside of the conditioning process. Particles coming from contaminants on and within the conditioning disk continue to be problematic for CMP processes.

Therefore, there is a need for an improved method of cleaning the pad conditioning device in order to remove the source of these particles.

SUMMARY OF THE DISCLOSURE

In satisfaction of the aforenoted needs, an improved chemical mechanical polish (CMP) system is disclosed. The disclosed CMP system comprises a conditioning device mounted to a robotic arm and a tank for the purpose of holding a liquid. This tank is coupled to an ultrasonic energy source for directing energy toward the interior of the tank. The robotic arm is capable of transferring the conditioning device to and from the polishing section of the CMP system and the tank where the conditioning device is separately cleaned with the assistance of ultrasonic energy.

The tank is preferably located near the polishing section of the CMP system, so that the transfer can be performed rapidly. The tank is designed so that the conditioning disk can be delivered through an opening of the tank and submerged in the liquid within the tank. Multiple tanks and multiple liquids can be used for the purpose of removing particles and chemical residues from the conditioning device.

BRIEF DESCRIPTION OF THE DRAWING

These and other features and advantages will become apparent from a detailed consideration of the disclosure when taken in conjunction with the accompanying drawing wherein.

Figure 1:
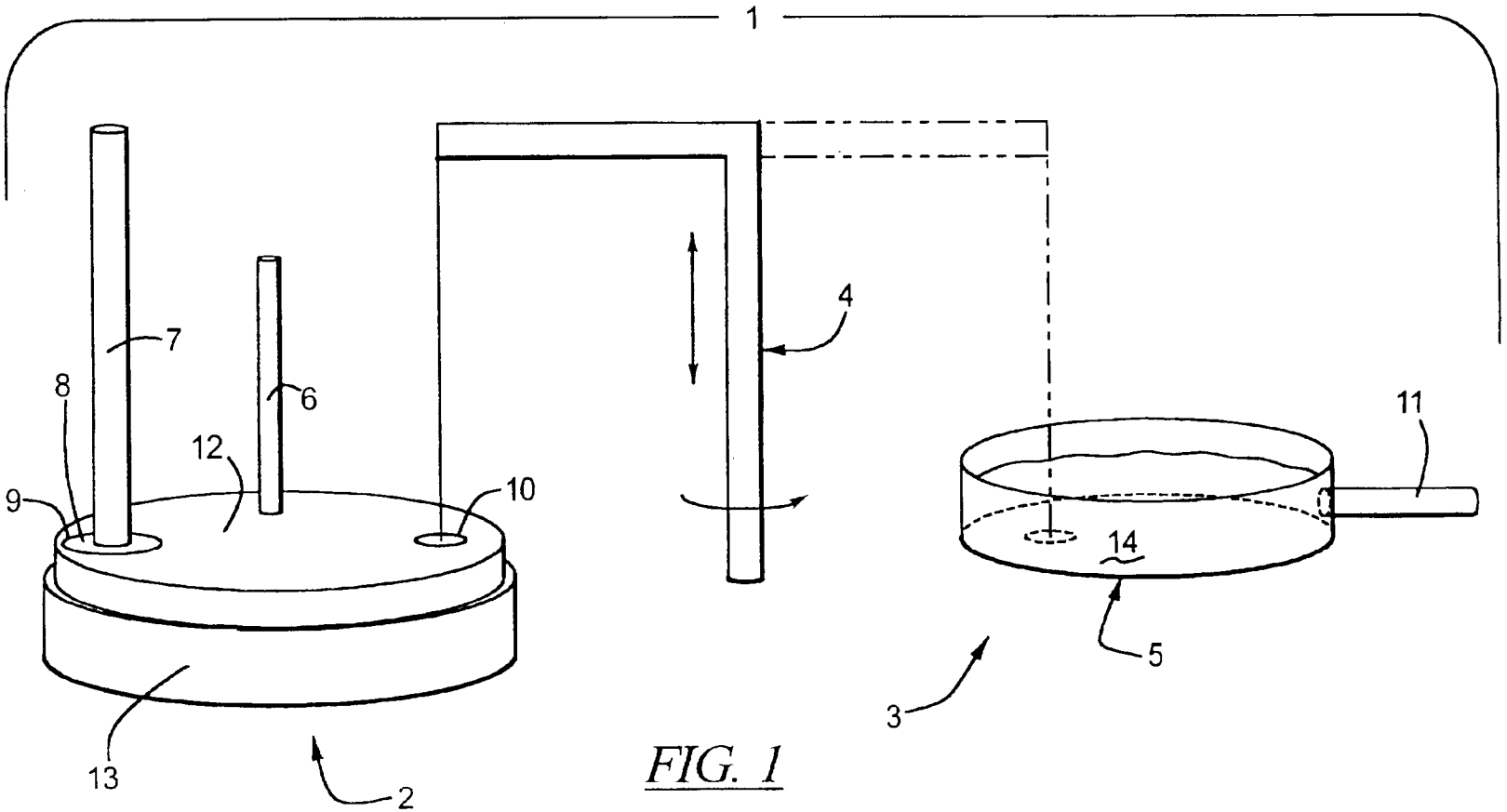
FIG. 1 is a schematic illustration of a chemical mechanical polishing system according to one embodiment of the disclosure.

It should be noted that the drawing is not necessarily to scale and that the embodiment is illustrated with phantom lines and diagrammatic representations. In certain instances, details which are not necessary for an understanding of the disclosure or which render other details difficult to perceive may have been omitted. It should be understood, of course, that the disclosure is not necessarily limited to the particular embodiment illustrated herein.

DETAILED DESCRIPTION OF THE PRESENTLY PREFERRED EMBODIMENTS

As shown in FIG. 1, a chemical mechanical polish (CMP) system 1 includes a CMP section 2 and a conditioning section or apparatus 3. An arm 4 is capable of rotatable pivotal movement between the polish pad area 2 and the cleaning tank 5 for transporting the conditioning device 10 from a position where the conditioning device or disk 10 engages the polish pad 12 as shown solid lines in FIG. 1 to a position where the conditioning disk or device 10 is submerged in the tank 5 as shown in phantom lines in FIG. 1. The arm 4 is capable of vertical and horizontal movements as necessary to perform this task.

A dispense nozzle 6 dispenses slurry onto the polish pad 12 while a spindle 7 presses the wafer 8 onto the polish pad 12. The polish pad 12 is disposed on a rotating platen 13. The wafer 8 is held in place by a carrier 9.

When it is time to clean the conditioning disk or device 10, the robotic arm 4 moves the disk 10 into the cleaning tank 5 and submerges the conditioning device or disk 10 in the liquid 14 present in the tank. Ultrasonic energy is delivered to the liquid 14 by an ultrasonic source 11.

The conditioning device 10 may be in the form of a disk or ring or other variation that will be apparent to those skilled in the art.

The combination of submerging the conditioning device 10 in the liquid 14 in the tank 5 and applying ultrasonic energy to the device 10 by way of the liquid 14 has been found to be very effective in removing particles from the conditioning device 10 and thus, these particles are kept away from the polish pad 12 where they can do damage to the wafer 8 and hence, a substantial reduction in defect levels can be achieved over prior art systems not using this technique. The tank 5 can be temperature controlled and may also have many different chemicals flowing or being sprayed into it in order to get the most effective cleaning process. More than one tank may also be utilized.

Accordingly, the description of the present invention is to be constructed as illustrative only and is for the purpose of teaching those skilled in the art the best mode of carrying out the invention. The details may be varied substantially without departing from the spirit and scope of the invention. Exclusive use of all modifications which are within the scope of the appended claims is reserved.

What is claimed:

1. A method comprising:

polishing an object with a polishing pad of a chemical mechanical polishing system;

conditioning the polishing pad while the object is being polished;

removing the conditioning device from the polishing pad;

transporting the conditioning device to a conditioning tank containing a conditioning liquid;

submerging the conditioning device in the conditioning liquid; and, applying ultrasonic energy to the submerged conditioning device.

2. The method of claim 1 wherein the removing and transporting are carried out with a robotic arm.

3. The method of claim 1 further comprising:

removing the conditioning device from the conditioning tank; and, returning the conditioning device to the polishing pad so as to condition the polishing pad while the object or a new object is being polished.

4. The method of claim 1 wherein the conditioning tank is disposed adjacent to the polishing pad.

5. The method of claim 1 wherein the conditioning tank is disposed remotely from the polishing pad.

6. The method of claim 1 wherein the polishing pad has first and second opposing sides, wherein the polishing pad comprises a polishing surface that engages the object being polished, wherein the polishing surface is on the first side of the polishing pad, and wherein the method further comprises dispensing a polishing fluid from the first side onto the polishing surface.

7. The method of claim 6 wherein the arm is further characterized as being a robotic arm.

8. The method of claim 6 wherein the conditioning tank is disposed adjacent to the polishing pad.

9. The method of claim 6 wherein the conditioning tank is disposed remotely from the polishing pad.

10. A method comprising:

polishing an object with a polishing pad of a chemical mechanical polishing system, wherein the polishing pad has first and second opposing sides, wherein the polishing pad comprises a polishing surface that engages the object being polished, and wherein the polishing surface is on the first side of the polishing pad;

dispensing a polishing fluid onto the polishing surface from a nozzle located farther away from the second side than from the first side;

conditioning the polishing pad;

removing the conditioning device from the polishing pad;

transporting the conditioning device to a conditioning tank containing a conditioning liquid;

submerging the conditioning device in the conditioning liquid; and, applying ultrasonic energy to the submerged conditioning device.

11. The method of claim 10 wherein the removing and transporting are carried out with a robotic arm.

12. The method of claim 10 further comprising:

removing the conditioning device from the conditioning tank; and, returning the conditioning device to the polishing pad.

13. The method of claim 10 wherein the conditioning tank is disposed adjacent to the polishing pad.

14. The method of claim 10 wherein the conditioning tank is disposed remotely from the polishing pad.

* * * * *